United States Patent [19]

Porter

[11] 3,972,656

[45] Aug. 3, 1976

[54] FUEL PUMP HAVING PULSATING CHAMBERS

[75] Inventor: David L. Porter, Madison, Ill.

[73] Assignee: ACF Industries, Incorporated, New York, N.Y.

[22] Filed: Dec. 16, 1974

[21] Appl. No.: 533,180

[52] U.S. Cl. ..... 417/542

[51] Int. Cl.[2] ..... F04B 11/00

[58] Field of Search ..... 417/540, 542, 470, 471, 417/541; 138/30, 31; 181/40, 41

[56] References Cited

UNITED STATES PATENTS

| | | | |
|---|---|---|---|
| 2,548,472 | 4/1951 | Gibson | 417/542 |
| 2,779,353 | 1/1957 | Coffey | 417/542 |
| 3,065,766 | 11/1962 | Wenzl | 138/30 |
| 3,096,721 | 7/1963 | White et al. | 417/542 |
| 3,291,065 | 12/1966 | Elder et al. | 417/542 |
| 3,362,341 | 1/1968 | Quatredeniers | 417/571 |
| 3,364,870 | 1/1968 | Quatredeniers | 417/571 |
| 3,370,543 | 2/1968 | Phillips | 417/542 |
| 3,874,417 | 4/1975 | Clay | 138/30 |

*Primary Examiner*—William L. Freeh
*Assistant Examiner*—G. P. LaPointe

[57] ABSTRACT

A reciprocating fuel pump for an internal combustion engine comprising a body having an outer wall defining a pumping chamber and a pair of generally cylindrical projections in fluid communication with the pumping chamber, the projections defining an intake cavity with an intake check valve therein and a discharge cavity with a discharge check valve therein. Elastomeric tubular conduits within the projections form the intake and discharge cavities and are of a flexibility sufficient to provide a collapsing and an expansion of the conduit walls upon relatively small pressure variations resulting from the suction and discharge strokes of the diaphragm. The elastomeric conduits thereby provide pulsating chambers to smooth out the flow of fuel and thereby increase the fuel flow through the fuel pump.

3 Claims, 6 Drawing Figures

FIG. 4
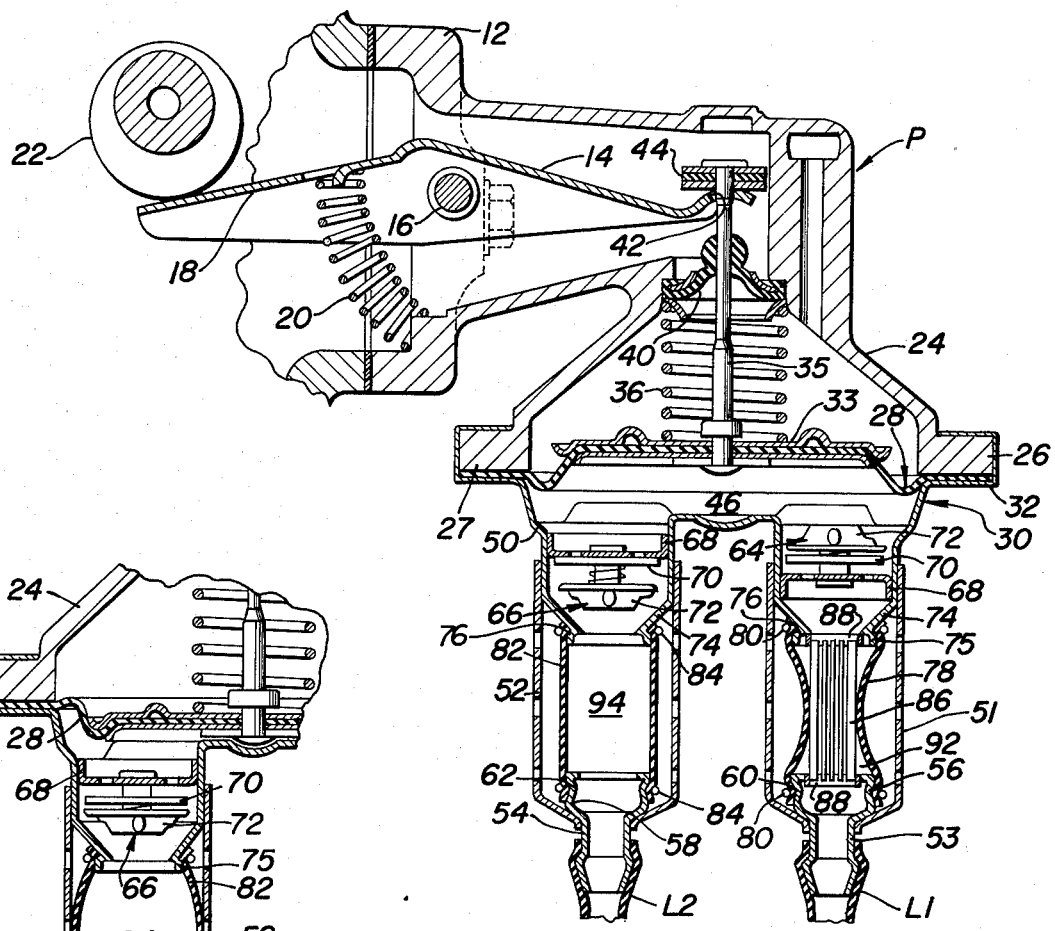
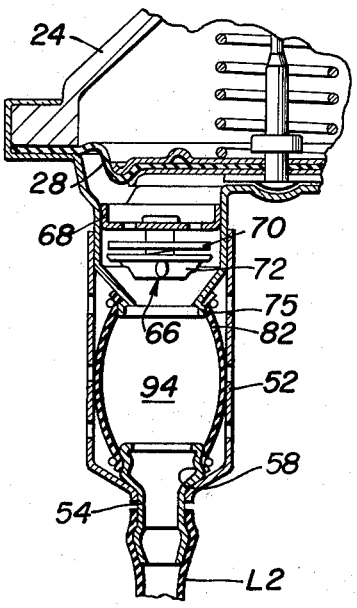
FIG. 5
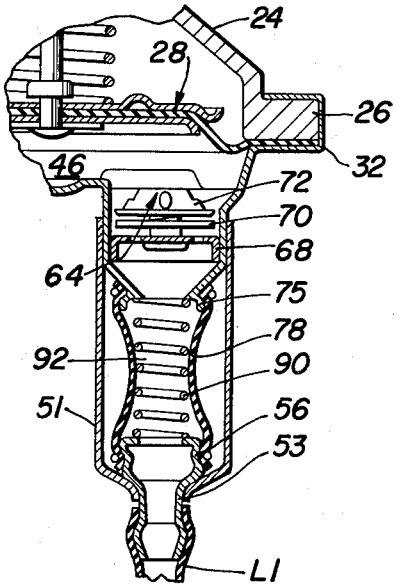
FIG. 6

FUEL PUMP HAVING PULSATING CHAMBERS

BACKGROUND OF THE INVENTION

During engine operation, the reciprocating action of a pump diaphragm sucks fuel through the inlet line to the pump in the fuel tank and forces the fuel through the discharge line of the pump into a carburetor. The fuel in the line between the pump and the fuel tank consists substantially of a long column of liquid having an inertia which must be overcome when the diaphragm sucks the fuel through the inlet line and which must be resisted when the fuel in the inlet line is suddenly stopped by the closing of the inlet valve each time the pump starts a pumping stroke. Also, the fuel in the outlet line of the pump extending to the carburetor contains a column of fuel which is moved rapidly outwardly and then stopped with the closing of the outlet valve each time the diaphragm reverses and provides a suction stroke. The inertia of the fuel in the outlet column must be overcome upon each movement of the fuel into the pumping chamber and upon the stopping of the fuel flow each time the discharge valve closes.

The pump diaphragm of a fuel pump in an automotive vehicle may reciprocate up to around 2,000 strokes a minute. At high speed the inlet valve and the discharge valve are opened and closed at substantially the same rate and it has been found that with an engine operating at such high speed, the inlet and discharge valves of the pump oftentimes do not operate efficiently at such a high pumping rate. Therefore, pulsation chambers or vapor domes have been provided heretofore to dampen the rapid pulsations of the pump so that the fuel is moved at an even rate through the inlet and outlet conduits and only the fuel adjacent the inlet and discharge valves of the pump is reciprocated at or upon each pumping stroke. By evening the fuel flow, a higher fuel flow through the fuel pump may be obtained.

DESCRIPTION OF THE PRESENT INVENTION

The present invention is directed to a diaphragm fuel pump for an internal combustion engine with the fuel pump comprising a body having an outer wall defining a pumping chamber with a pair of generally cylindrical projections extending from the wall and in fluid communication with the pumping chamber. The projections define an intake cavity having an intake check valve therein and a discharge cavity having a discharge check valve therein. Elastomeric tubular conduits are provided within the projections and form the intake and discharge cavities. The elastomeric tubular conduits are formed of rubber or rubber-like material and are of a sufficient flexibility to contract and expand readily upon any changes of pressure resulting from the suction and discharge strokes of the diaphragm. The fuel flow is through the tubular conduits and the tubular conduits by contracting and expanding provide pulsation chambers for the intake and discharge cavities thereby to even the flow of fuel through the pumping chamber and to provide a relatively high flow rate. The tubular conduits are of a diameter between around one-half inch and one and one-half inch and on the suction stroke, the inlet tubular conduit will normally collapse partially while on the discharge stroke, the discharge tubular conduit will normally expand or bulge outwardly. Means are provided to limit the inward collapsing of the tubular conduit for the inlet and separate means are provided to limit the bulging or expanding outwardly of the tubular discharge conduit.

In the accompanying drawings, in which two of various possible embodiments of the invention are illustrated, FIG. 1 is an elevational view, partly schematic, illustrating a diaphragm pump comprising the present invention in use on an internal combustion engine of an automotive vehicle;

FIG. 4 is a section similar to FIG. 2 but showing the diaphragm in a suction stroke with the inlet valve in an open position;

FIG. 5 is an enlarged view of the discharge cavity showing the discharge valve in an open position with the tubular conduit expanded outwardly during the discharge stroke of the diaphragm; and FIG. 6 is a modified form of the invention in which a perforated cage surrounds the inlet cavity and a spring is housed within the tubular conduit to limit the contraction of the tubular conduit during the suction stroke with the inlet valve in an open position.

Figure 1:
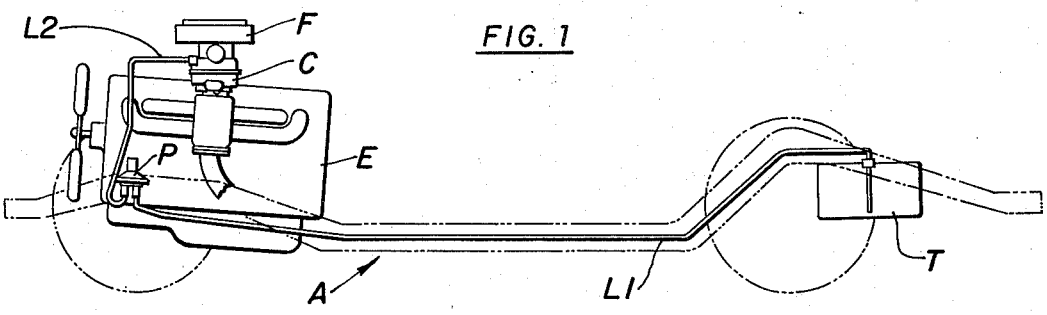

Referring to FIG. 1 of the drawings, an automotive vehicle is indicated generally at A having an engine E on which is mounted a fuel pump P comprising the present invention. Fuel is delivered from fuel tank T of the vehicle through a supply line L1 to fuel pump P and delivered by fuel pump P through line L2 to carburetor C of engine E. The carburetor is mounted on the intake manifold of engine E and an air filter F is shown mounted on the air horn of carburetor C.

Figure 2:
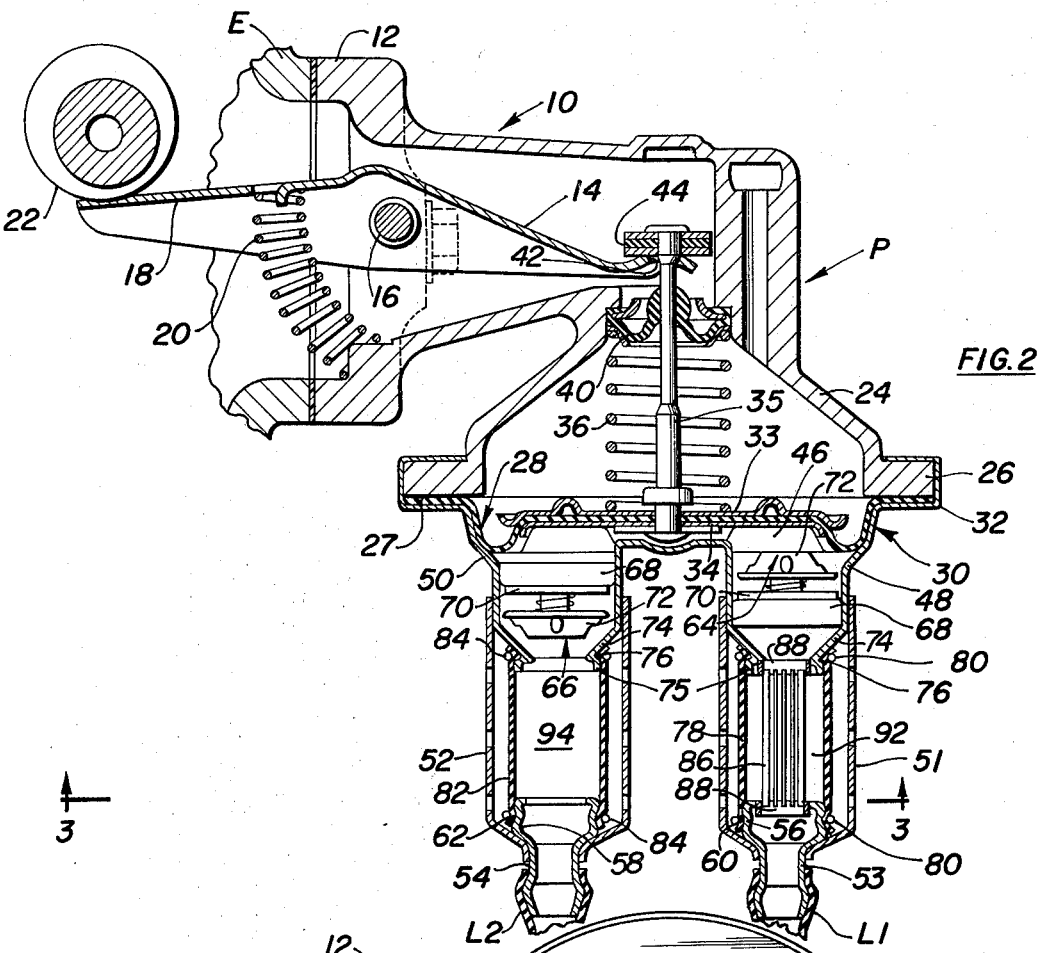
FIG. 2 is an enlarged vertical section of the pump shown in FIG. 1 with both the inlet and discharge valves in a closed position.
Figure 3:
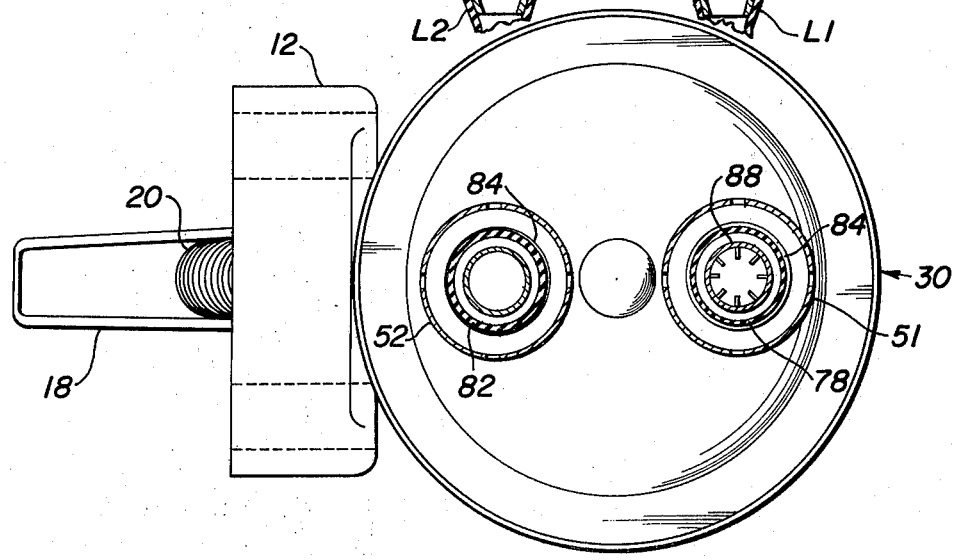
FIG. 3 is a section taken generally along line 3—3 of FIG. 2.

Pump P is a so-called inverted pump, i.e., the inlet and outlet of the pump are located at the bottom of the pump. Pump P comprises a rocker arm housing 10 which is open at one end and has a flange 12 for attachment to engine E. A rocker arm 14 is pivoted at 16 in housing 10 for rocking movement on a horizontal axis transverse to housing 10. Arm 14 has an outer end portion 18 projecting out of the open end of housing 10 and biased by a spring 20. When pump P is mounted on an engine, end portion 18 of rocker arm 14 is engaged by an engine-driven eccentric cam 22. The low point of cam 22 engages rocker end portion 18 and upon rotation of cam 22 rocker arm 14 is rocked in a counterclockwise direction from the position shown in FIG. 2.

Extending downwardly from rocker arm housing 10 is a hollow generally conical pump head or housing 24 having a peripheral flange 26 thereon. The downwardly facing surface of flange 26 forms a seat for a marginal portion 27 of diaphragm 28 which may be formed of a relatively thin disc of flexible fuel-resistant material, such as a suitable synthetic rubber. The outer marginal portion 27 is clamped against flange 26 by a pump body generally indicated at 30 having an outer marginal portion 32 which is crimped around the outer surface of flange 26. Outer marginal body portion 32 provides a fuel-tight seal about the outer marginal portion of diaphragm 28.

Diaphragm 28 is clamped between upper and lower plates 33 and 34. An actuating rod 35 for diaphragm 28 has a lower end portion secured beneath lower plate 34 and a spring 36 about rod 35 is biased between diaphragm plate 33 and a seal retainer ring 40. Rocker arm 14 has a slot 42 fitting about rod 35 and a collar 44 is fitted adjacent rocker arm 14 about rod 35. When rocker arm 14 moves in a clockwise direction, spring 36 is adapted to drive diaphragm 28 and actuating rod 35 in a downward direction. A pumping chamber 46 is formed beneath diaphragm 28.

Pump body 30 is formed of sheet metal and has two integral generally cylindrical projections 48 and 50. Forming a continuation of integral projections 48 and 50 are outer perforated cages 51 and 52 forming suitable protective housings for intake and discharge cavities or chambers. Cages 51 and 52 may be suitably secured to integral projections 48 and 50 such as by spot welding or the like. An inlet nipple 53 is connected to supply line L1 and an outlet nipple 54 is connected to discharge line L2. Nipples 53 and 54 are received and extend within perforated cages 51 and 52. The upper end portions of nipples 53 and 54 are flared outwardly to form upper rims 56 and 58 having respective annular grooves 60 and 62. An intake check valve 64 is provided in projection 48 and a discharge check valve 66 is provided within projection 50. The check valves are of identical construction and may be of a type well-known in the fuel pump art, each comprising a valve seat 68 for a disc valve member 70 and a mushroom head stem 72 extending from valve seat 68 with a spring surrounding the stem and pressing disc valve member 70 toward its respective seat. Seats 68 are press fitted within projections 48 and 50 with valve members 70 positioned reversely with respect to each other so that inlet valve 64 opens in one direction and discharge valve 66 opens in the opposite direction.

Each integral projection 48, 50, has a tapered lower end portion 74 terminating in a peripheral rim 75 forming an outwardly facing annular groove 76. Secured and extending between rim 56 and end portion 74 is an inlet tubular conduit 78. Inlet tubular conduit 78 extends about grooves 60 and 76 and suitable fasteners, such as ring clamps 80, secure tubular conduit 78 about rims 56 and 75.

Secured and extending between rim 58 and opposed end portion 74 is an outlet tubular conduit 82. Tubular conduit 82 extends about grooves 62 and 76 and suitable fasteners, such as ring clamps 84, secure marginal portions of tubular conduit 82 to rims 58 and 75. Tubular conduits 78 and 82 are elastomeric preferably formed of a rubber or rubber-like material which has sufficient flexibility to expand and contract upon relatively small changes in pressure. Conduits 78 and 82 may be around one inch in diameter and may vary from around one-half inch to one and one-half inches in diameter.

To restrict the inward collapsing or contraction of inlet tubular conduit 78, particularly as shown in FIG. 4 during the suction stroke of diaphragm 28 with inlet valve 64 in an open position, longitudinally extending ribs 86 are secured between rings 88 which are mounted within and secured to rims 56 and 75. Outer protective cages 51 and 52 restrict and limit the outward expanding or bulging of tubular conduits 78 and 82 as shown in FIG. 5. With discharge valve member 70 shown in an open position, tubular conduit 82 is expanded outwardly against protective cage 52. In addition to limiting the outward expansion of tubular conduits 78 and 82, cages 51 and 52 protect tubular conduits 78 and 82 from workmen or foreign matter, such as rocks or the like, which may be deflected against such tubular conduits.

A modified construction of the inlet chamber is illustrated in FIG. 6 in which inlet valve member 70 is shown in an open position with diaphragm 28 in a suction stroke. To restrict tubular conduit 78 against collapsing, a coil spring 90 is mounted within tubular conduit 78 between rims 56 and 75. It is apparent that other similar types of arrangements may be provided to limit the inward collapsing of tubular conduit 78. Likewise, it is to be understood that other similar arrangements of protective housings may be provided about tubular conduits 78 and 82 for limiting the outward expansion thereof and to protect the conduits.

The space formed within elastomeric tubular conduits 78 and 82 provides respective pulsation or dampening chambers 92 and 94. The pulsations through the pump chamber are dampened to an extent that fuel flow in lines L1 and L2 becomes more uniform and only the fuel adjacent valves 64 and 66 go through a rapid starting and stopping cycle upon the reciprocation of pump diaphragm 28. Upon the quick reversal of pump diaphragm 28 in a direction of the discharge stroke, the fuel moving through inlet line L1 is stopped and inlet valve 64 is closed so that the fuel in the pumping chamber is forced through the discharge outlet. During the pumping stroke the column of fuel in line L2 is forced upwardly into the carburetor. During the suction stroke of pump P the column of fuel in outlet line L2 is substantially stationary because of the closed outlet valve 66 while during the pumping stroke the column of fuel in inlet line L1 is substantially stationary because of the closing of inlet valve 64 to pump P. During rapid reciprocation of the pump at high engine speeds, the stopping and starting of the fuel in lines L1 and L2 present an uneven flow and at very high speeds of pump reciprocation the inlet and outlet valves sometimes do not operate in a most efficient manner. With dampening or pulsation chambers 92 and 94 established by tubular conduits 78 and 82 a more even flow of fuel is provided through the fuel pump.

In operation, on demand of fuel from the carburetor, diaphragm 28 is flexed up by the action of cam 22 and intake check valve 64 opens and discharge check valve 66 closes and fuel is drawn into the pumping chamber below diaphragm 28. On a downward or discharge stroke of diaphragm 28, intake check valve 64 closes and discharge valve 66 opens and fuel is forced out through line L2 to carburetor C. Elastomeric tubular conduits 78 and 82 act as conduits for the flow of fuel immediately adjacent valves 64 and 66 and are able to contract or expand as the case may be thereby to provide a dampening chamber on the intake side as well as on the outlet side. An improved rate of fuel flow through pump P is thus provided.

What is claimed is:

1. A diaphragm fuel pump comprising a body having an outer wall defining a pumping chamber and a generally cylindrical shaped projection extending from said wall and in fluid communication with said chamber, said projection defining a fuel cavity having a check valve therein, said projection terminating in a peripheral rim, an outer perforated cage sealed to said projection and forming an extension thereof, a fuel nipple inserted in an end of said cage remote from said projection, said nipple having an outwardly flared inner end portion, an elastomeric tubular fuel conduit sealed to and extending from said peripheral rim, said fuel conduit also being sealed to said flared end, and wherein said elastomeric fuel conduit serves as a pulsation dampener and is restrained in its outward expansion by said perforated cage.

2. A diaphragm fuel pump according to claim 1 wherein the said check valve is an inlet check valve and wherein means are provided within said elastomeric conduit to prevent collapsing thereof.

3. A diaphragm fuel pump according to claim 1 wherein the said check valve is a discharge check valve.

* * * * *